US006070578A

United States Patent [19]

Baughman et al.

[11] Patent Number: 6,070,578

[45] Date of Patent: Jun. 6, 2000

[54] BREATH ODOR ELIMINATOR MASK

[76] Inventors: David A. Baughman, 506 N. 8th St.; Larry E. Millis, 1506 A St., both of Neodesha, Kans. 66757

[21] Appl. No.: 09/072,194

[22] Filed: May 4, 1998

Related U.S. Application Data

[60] Provisional application No. 60/075,536, Feb. 23, 1998.

[51] Int. Cl.[7] ..... A62B 23/02

[52] U.S. Cl. ..... 128/205.27; 128/205.28; 128/206.19

[58] Field of Search ..... 128/205.27, 205.28, 128/206.12, 206.13, 206.19

[56] References Cited

U.S. PATENT DOCUMENTS

| | | | |
|---|---|---|---|
| 3,101,709 | 8/1963 | Gruenewaelder | 128/206.12 |
| 3,884,227 | 5/1975 | Lutz et al. | 128/206.19 |
| 4,285,068 | 8/1981 | Ross | 2/202 |
| 4,355,637 | 10/1982 | Dyer | 128/206.19 |
| 4,467,799 | 8/1984 | Steinberg | 128/206.19 |
| 4,503,851 | 3/1985 | Braunroth . | |
| 4,790,307 | 12/1988 | Haber et al. . | |
| 4,920,960 | 5/1990 | Hubbard et al. | 128/206.12 |
| 5,025,507 | 6/1991 | Kirby | 2/206 |
| 5,091,996 | 3/1992 | Kirby | 2/206 |
| 5,117,821 | 6/1992 | White . | |
| 5,269,294 | 12/1993 | Rogozinski . | |
| 5,383,236 | 1/1995 | Sesselmann | 2/243.1 |
| 5,551,087 | 9/1996 | Blutstein et al. | 2/173 |
| 5,636,628 | 6/1997 | Barnum . | |
| 5,652,963 | 8/1997 | Davison | 2/206 |
| 5,697,105 | 12/1997 | White . | |
| 5,803,077 | 9/1998 | Gazzara | 128/206.13 |

OTHER PUBLICATIONS

Calgon Carbon Corporation: "Activated Carbon Cloth" (Brochure Attached), Date Unknown.

*Primary Examiner*—Aaron J. Lewis
*Attorney, Agent, or Firm*—Tipton L. Randall

[57] ABSTRACT

A multi-layer hunting mask adapted to be close fitting at least over the nose and mouth of a wearer for eliminating odorous compounds from the exhaled breath of a wearer is disclosed. The mask includes an inner air-permeable fabric mesh layer, a middle activated carbon fiber fabric mesh layer, and an outer air-permeable fabric layer having a camouflage pattern. The inner, middle and outer layers are fastened together to provide a continuous, flexible nose and mouth covering mask for the wearer. The mask has at least one elastomeric loop for securing the mask over the mouth and nose of the wearer. A method of making the mask and a method of using the mask are also disclosed.

10 Claims, 2 Drawing Sheets

BREATH ODOR ELIMINATOR MASK

CROSS REFERENCE TO RELATED APPLICATION

This application claims the benefit under 35 U.S.C. §119 (e) of co-pending provisional application Ser. No. 60/075,536, filed Feb. 23, 1998. Application Ser. No. 60/075,536 is hereby incorporated by reference.

FIELD OF THE INVENTION

The invention relates to a mask for eliminating breath odor, and more particularly to a mask containing activated carbon fiber cloth for this purpose.

BACKGROUND OF THE INVENTION

Game animals have a heightened sense of smell, often detecting predators or humans without seeing them. Often this detection is by scent alone. Hunters often employ cover scent to mask their human scent in order to approach the quarry at close range. The hunter's exhaled breath may contain odorous substances from consumed food or smoking materials. The presence of these odorous compounds in the hunter's breath may be less than the odor threshold that human individuals can detect, and thus are not apparent. To the hunter's dismay, these low levels are detectable by game animals, thus putting the hunter at a disadvantage.

Thus, there is a need for a means to prevent a hunter's odorous breath components from escaping to the atmosphere where the odor will warn the quarry of the hunter's presence. The means to accomplish this end must not interfere with the hunter's firing an arrow or bullet at the quarry. Several innovations for eliminating breath odor or preventing the spread of disease pathogens are found in the following patents.

Braunroth, in U.S. Pat. No. 4,503,851, discloses a face mask with a mass of absorbent material saturated with odor-masking substances. A face mask with odor absorbing molecular sieves is disclosed by Rogozinski in U.S. Pat. No. 5,269,294. Masks having odor-masking, odor-counteracting or anti-bacterial substances are disclosed by Haber et al. in U.S. Pat. No. 4,790,307 and by Barnum in U.S. Pat. No. 5,636,628. G. White discloses a hunting face mask with a carbon canister to control breath odor in U.S. Pat. No. 5,117,812. M. White, in U.S. Pat. No. 5,697,105, discloses a hunting mask having activated charcoal (carbon) to absorb breath odors. The carbon is contained in stitched together pockets between two cloth layers. The outer surface may have a camouflage pattern for visual concealment. A single elastic band secures the mask to the head of the wearer. The mask also contains an outer seal such as rubber or plastic to provide a tight seal, plus a one way valve for intake of air. The patent also indicates that the adsorbent may be impregnated in the fabric of the mask to provide the same function.

Thus, there remains an unmet need for a breath odor eliminating mask that fits closely over the nose and mouth of the wearer to absorb odorous breath components. The mask needs to be flexible to conform closely to the contour of any wearer's face, yet allow for unhindered shooting of an arrow from a bow or bullet from a rifle. The mask needs to blend into surrounding foliage or terrain, and to operate completely in silence so as not to alert game animals to the presence of the hunter.

SUMMARY OF THE INVENTION

The present invention is a multi-layer hunting mask adapted to be close fitting at least over the nose and mouth of a wearer for eliminating odorous compounds from the exhaled breath of a wearer. The mask comprises an inner air-permeable fabric mesh layer, a middle activated carbon fiber fabric mesh layer having an internal surface area of at least about 1,000 square meters per gram, and an outer air-permeable fabric layer having a camouflage pattern. The inner, middle and outer layers are fastened together to provide a continuous, flexible nose and mouth covering mask for the wearer. The mask has at least one elastomeric loop for securing the mask over the mouth and nose of the wearer. Also disclosed is a method of making the mask and a method of using the mask to eliminate odorous compounds from the exhaled breath of a wearer.

DETAILED DESCRIPTION OF THE PREFERRED EMBODIMENT

Nomenclature

| | |
|---|---|
| 10 | Multilayer Mask Member |
| 12 | Horizontal Edges of Mask Member |
| 14 | Vertical Edges of Mask Member |
| 20 | Mesh Fabric Inner Layer |
| 22 | Horizontal Edges of Inner Layer |
| 24 | Vertical Edges of Inner Layer |
| 30 | Activated Carbon Fabric Middle Layer |
| 32 | Horizontal Edges of Middle Carbon Fabric Layer |
| 34 | Vertical Edges of Middle Carbon Fabric Layer |
| 40 | Camouflage Fabric Outer Layer |
| 42 | Horizontal Edges of Outer Layer |
| 44 | Vertical Edges of Outer Layer |
| 50 | Elastomeric Loop Members |
| 60 | Flexible Metal Nose Strip Member |

Construction

Figure 1:
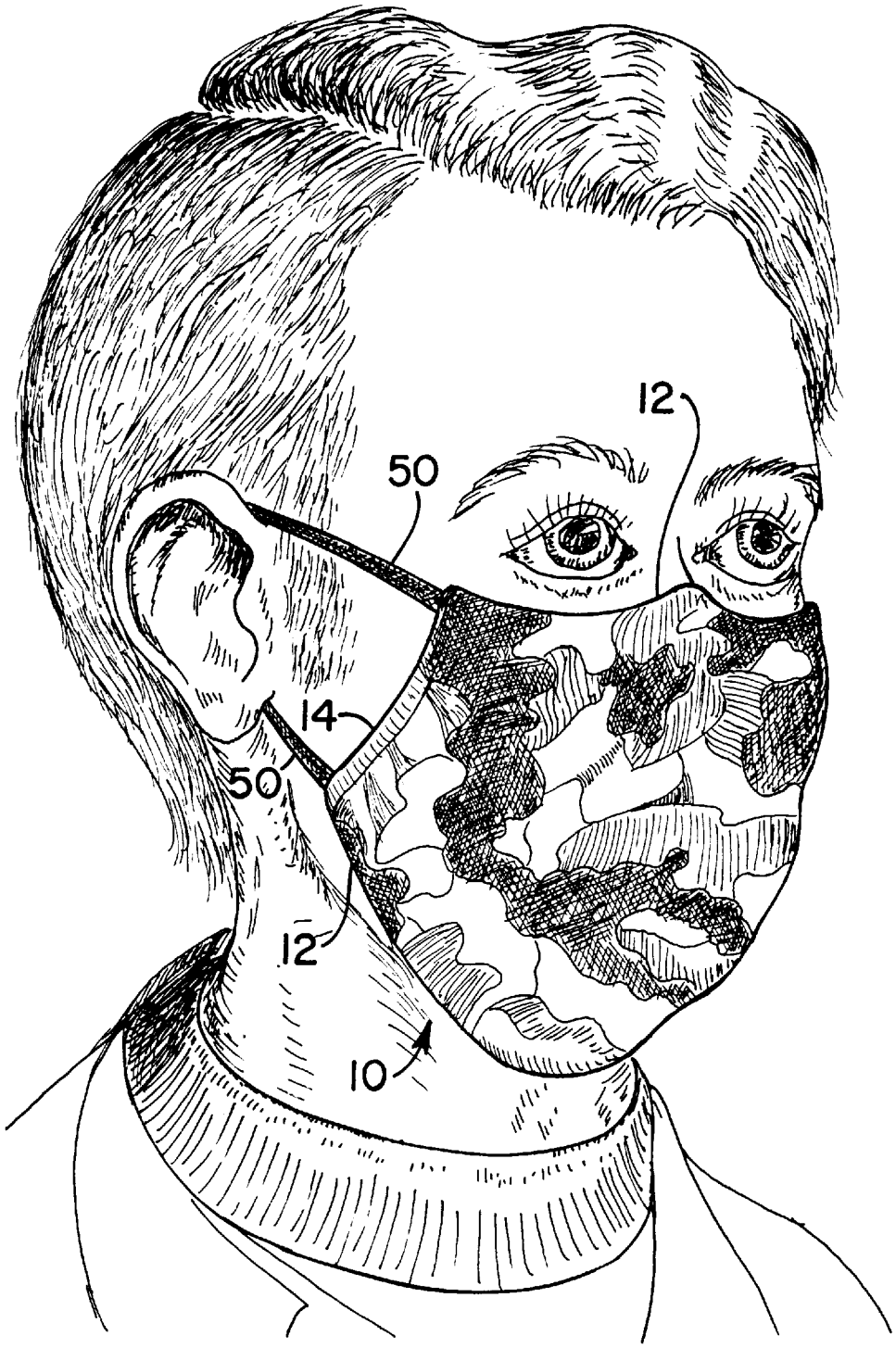
FIG. 1 is the breath odor eliminator mask of the present invention worn by an individual.
Figure 2:
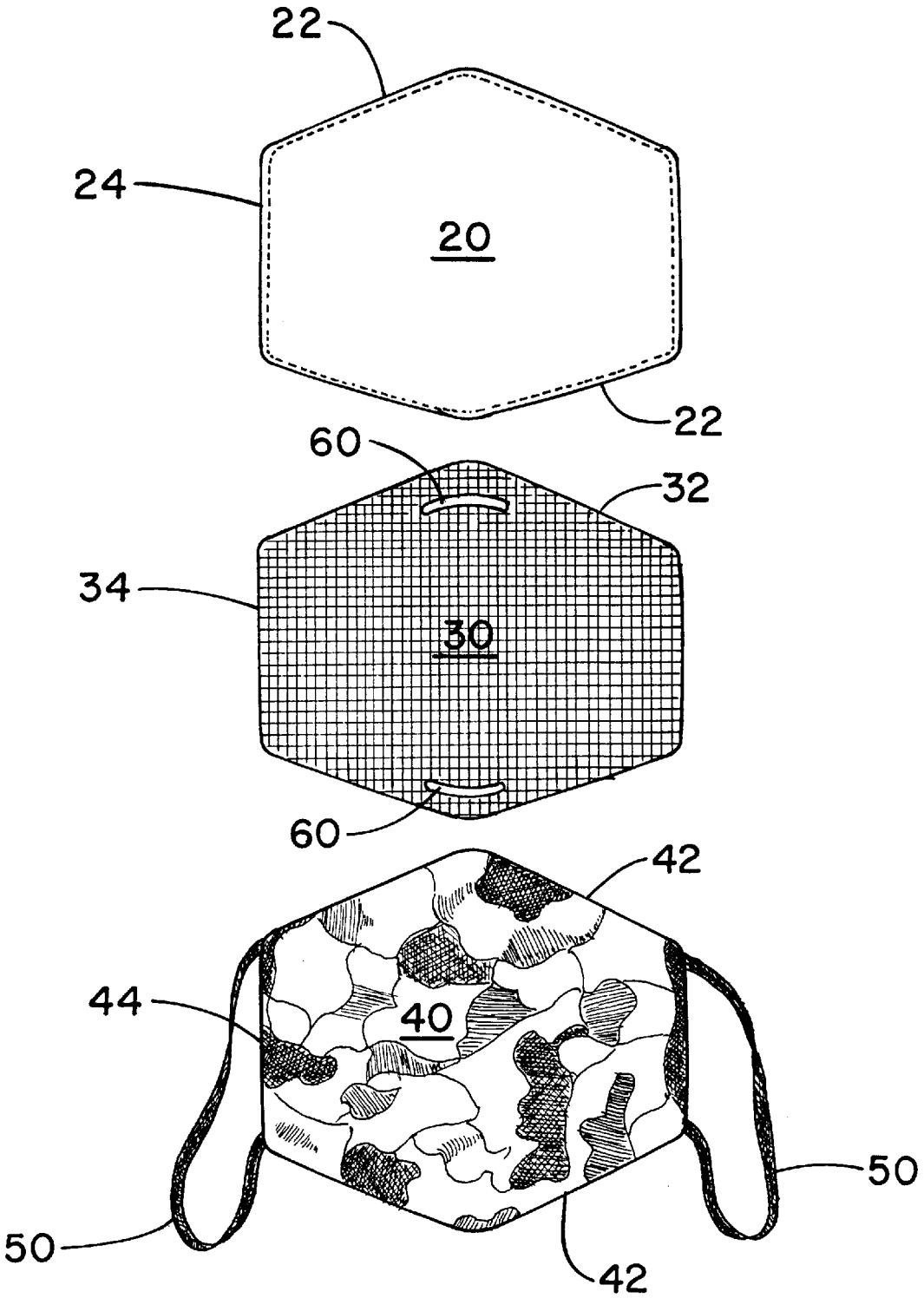
FIG. 2 is an exploded view of the component layers of the breath odor eliminator mask.

Referring to FIG. 1, the multilayer mask member 10 of the present invention is shown as worn by an individual over his mouth and nose, with the mask member 10 secured around the wearer's ears. The horizontal edges 12 of the mask member 10 fit across the nose and under the chin of the wearer, while the vertical edges 14 of the mask member 10 are positioned on the upper cheek area of the wearer. The layers comprising the mask member 10 are shown in FIG. 2. The component layers of the mask member 10 are fabricated in the shape of an elongated hexagon so as to conform to the wearer's face when the components are assembled into the finished mask member 10. The inner mesh fabric layer 20 has longer horizontal edges 22 and shorter vertical edges 24. The inner mesh fabric layer 20 is highly permeable to air and comes in contact with the wearer's facial area.

The activated carbon fabric middle layer 30 likewise has longer horizontal edges 32 and shorter vertical edges 34. The activated carbon fabric middle layer 30 is particularly well suited to absorbing odorous components from the wearer's exhaled breath. The carbon fabric 30 is light weight at about 95 to 115 grams per square meter and has an extremely high surface area of at least about 1,000 square meters per gram. The carbon fabric 30 is surprisingly flexible and resilient in nature, and is highly permeable to air flow through the fabric 30. The carbon fabric 30 is commercially available from Calgon Carbon Corporation, Pittsburgh, Pa. The activated carbon fabric 30 is available as a woven or a knitted fabric, and either form may be employed in the mask of the present invention. The activated carbon cloth is available in various weights and weaves, these varieties designated as products FM1/250, FM5/250, FM1K/250 and FM5K/250 by the supplier. These activated carbon cloth products have densities that range from about 100 to 220 grams per square meter.

The outer fabric layer 40 of the mask member 10 also has longer horizontal edges 42 and shorter vertical edges 44. This fabric layer 40 has a camouflage pattern to blend in with the foliage or terrain occupied by the hunter wearing the mask member 10. The camouflage fabric layer 40 also is highly permeable to air flow through it.

The three layers of the mask member 10 are combined in the above order, in alignment or register, and fastened together at the edges. The layers are preferably sewn or stitched together with thread or the like. There is also provided a means for securing the combined mask layers to the facial area of a wearer. The securing means is preferably a pair of elastomeric loop members 50, one fastened to each shorter vertical edge 14 of the multilayer mask member 10. The loop members 50 are sized to encircle the wearer's ear and pull the mask member 10 tightly over the wearer's nose and mouth. Alternatively, a single loop member 50 with one end connected to each of the vertical edges 44 of the mask member 10 may be used. The single loop member 50 is sized to encircle the rear of the head or neck of the wearer, and secures the mask member 10 over the wearer's nose and mouth.

It is preferred that, during the fastening together of the mask layers, a flexible metal nose strip 60 be secured between two layers, preferably between the outer fabric layer 40 and middle carbon fabric layer 30 near the middle of one horizontal edge 12 of the resulting mask member 10. The flexible strip 60 may be made of aluminum and allows the mask member horizontal edge 12 crossing the nose of the wearer to conform tightly thereto by bending the enclosed strip 60 to fit tightly over the nose.

It is also preferred that, during the fastening of the layers together to form the mask member 10, the elastomeric loop members 50 be fastened to the vertical edges 14 of the mask with the loop members 50 stretched to a selected extent. Thus, after fastening, the loop members 50 return to a relaxed condition and draw the vertical edges 14 of the mask member 10 together, providing a tighter fit under the chin and over the nose of the wearer.

The hunting mask of the present invention is particularly well suited for use in the field. In addition to eliminating odorous compounds from the wearer's exhaled breath, the highly flexible, close fitting mask member 10 does not interfere with the hunter firing an arrow or bullet toward the quarry. When firing an arrow from a bow, the hunter draws the bowstring holding the arrow close to the hunter's face to aim the arrow. Most hunters use an "anchor point" on the side of their face when aiming. The thumb of the hand used to draw the bowstring holding the arrow is placed on the cheek "anchor point" to provide a constant release position for the arrow. The bow string is positioned close to the eye used for aiming, often contacting the facial area of the hunter prior to release of the bowstring and arrow. With other rigid hunting masks, the arrow and bowstring are prevented from approaching the hunter's facial area, thus impairing the aiming and firing of the arrow. Likewise, when firing a rifle, the hunter places his cheek very close or upon the stock of the rifle and looks down the rifle barrel to align the sights on the target. Other rigid masks can interfere with this aiming process, impairing the firing of the bullet toward the quarry. The hunting mask of the present invention does not interfere with firing either a bow and arrow or a rifle at a hunter's quarry.

In a further embodiment of the invention, a second flexible metal nose strip 60 is secured between two mask layers, preferably between the outer fabric layer 40 and middle carbon fabric layer 30 near the middle of the horizontal edge 12 of the mask member 10 opposite the first metal nose strip 60. Thus, the wearer need not worry about orienting the mask member 10 with the metal nose strip 60 positioned over the wearer's nose, since both horizontal edges 12 of the mask member have a nose strip 60.

In yet a further embodiment of the invention, the mesh fabric inner layer 20 is selected to be generally white in color, thereby enabling the mask member 10 to be reversible. In the reversed orientation, the camouflage fabric layer 40 is positioned against the wearer's face and the generally white mesh fabric layer 20 becomes the exposed outer layer of the mask member 10. This generally white exterior breath odor absorbing mask is employed when hunting in snow conditions, providing a mask that blends with the snow-covered terrain.

The reversible feature of the hunting mask member 10 allows the wearer to use a single mask for a variety of foliage and terrain conditions without the added expense of two separate masks, each having a different exterior coloration and pattern.

In yet a further embodiment of the invention, the mesh fabric inner layer 20 is selected to have a camouflage pattern, thereby enabling the mask member 10 to be reversible. Thus, regardless of which exterior layer is exposed, the mask member 10 blends in with the foliage or terrain occupied by the hunter wearing the mask member 10. The camouflage fabric layer 20 also is highly permeable to air flow through it.

The hunting mask member 10 of the present invention also functions to prevent odors in the atmosphere from reaching the nose and mouth of the wearer. This feature is beneficial where the wearer may be allergic to certain vapors or odors present at the hunting location.

The invention also includes a method of eliminating odorous compounds from the exhaled breath of an individual. The method comprises providing a multi-layer mask member adapted to be close fitting at least over the nose and mouth of a wearer. The mask member is comprised of an inner air-permeable fabric layer, a middle activated carbon fiber fabric layer having an internal surface area of at least about 1,000 square meters per gram and an outer air-permeable fabric layer. The multilayer mask member is secured over the mouth and nose of the wearer by a securing means attached to the mask member.

The invention additionally includes a method of making a multi-layer mask member adapted to be close fitting at least over the nose and mouth of a wearer, the mask member eliminating odorous compounds from the exhaled breath of the wearer. The method comprises obtaining a multi-layer fabric made of an inner air-permeable fabric layer, a middle activated carbon fiber fabric layer having an internal surface area of at least about 1,000 square meters per gram, an outer air-permeable fabric layer. The multi-layer fabric is fashioned into an elongated hexagon shape mask member sized to cover at least the nose and mouth of a wearer. A means for securing the multilayer mask member over at least the nose and mouth of said wearer is attached to the mask member While the invention has been particularly shown and described with reference to a preferred embodiment thereof, it will be understood by those skilled in the art that various changes in form and details may be made therein without departing from the spirit and scope of the invention.

We claim:

1. A reversible multi-layer hunting mask adapted to be close fitting at least over a wearer's nose and mouth for eliminating odorous compounds from a wearer's exhaled breath comprising;

a) an inner air-permeable fabric mesh layer having a camouflage pattern thereon;

b) a middle activated carbon fiber fabric mesh layer having an internal surface area of at least about 1,000 square meters per gram;

c) an outer air-permeable fabric layer having a camouflage pattern thereon, said inner, middle and outer layers peripherally fastened together to provide a continuous, flexible nose and mouth covering mask member for the wearer, said mask member having vertical and horizontal edges; and d) means for securing said multilayer mask over a wearer's mouth and nose, whereby said mask member is reversible with said inner camouflage pattern layer as an outer layer and said outer camouflage layer as an inner layer.

2. The multi-layer hunting mask according to claim 1 further comprising a flexible, deformable metal strip member secured between two of said mask layers and positioned near a midpoint of one horizontal edge of said mask member.

3. The multi-layer hunting mask according to claim 1 wherein said means for securing said multilayer mask over a wearer's nose and mouth comprises a pair of elastomeric loop members, one loop member secured to each vertical edge of said mask member for encircling a wearer's ears.

4. The multi-layer hunting mask according to claim 1 wherein said means for securing said multilayer mask over a wearer's nose and mouth comprises an elastomeric loop member with ends secured to each vertical edge of said mask member for encircling a wearer's head.

5. A reversible multi-layer hunting mask adapted to be close fitting at least over a wearer's nose and mouth for eliminating odorous compounds from a wearer's exhaled breath comprising;

a) a first exterior air-permeable fabric mesh layer of generally white finish;

b) a middle activated carbon fiber fabric mesh layer having an internal surface area of at least about 1,000 square meters per gram;

c) a second exterior air-permeable fabric layer having a camouflage pattern thereon, said exterior layers with middle layer there between fastened peripherally together to provide a continuous, flexible nose and mouth covering mask member for a wearer, said mask member having vertical and horizontal edges; and d) means for securing said multilayer mask over a wearer's nose and mouth, whereby said mask member is reversible with said inner generally white finish layer as an outer layer and said outer camouflage layer as an inner layer.

6. The multi-layer hunting mask according to claim 5 further comprising a flexible, deformable metal strip member secured between two of said mask layers and positioned near a midpoint of one horizontal edge of said mask member.

7. The multilayer hunting mask according to claim 5 wherein said means for securing said multilayer mask over a wearer's nose and mouth comprises a pair of elastomeric loop members, one loop member secured to each vertical edge of said mask member for encircling a wearer's ears.

8. The multi-layer hunting mask according to claim 5 wherein said means for securing said multilayer mask over a wearer's nose and mouth comprises an elastomeric loop member with ends secured to each vertical edge of said mask member for encircling a wearer's head.

9. A method of eliminating odorous compounds from an individual's exhaled breath comprising;

a) providing a reversible multi-layer mask member adapted to be close fitting at least over a wearer's nose and mouth, said reversible mask member comprised of an inner air-permeable fabric layer, a middle activated carbon fiber fabric layer having an internal surface area of at least about 1,000 square meters per gram, and an outer air-permeable fabric layer, said inner, middle and outer layers fastened peripherally together;

b) selecting one of said air permeable fabric layers for contact with a wearer's face; and c) securing said reversible multilayer mask member over at least a wearer's mouth and nose by securing means attached to said mask member with said selected air permeable fabric layer contacting the wearer's face.

10. A method of making a multi-layer mask member adapted to be close fitting at least over a wearer's nose and mouth, said mask member eliminating odorous compounds from a wearer's exhaled breath, said method comprising;

a) obtaining a multi-layer fabric made of an inner air-permeable fabric layer, a middle activated carbon fiber fabric layer having an internal surface area of at least about 1,000 square meters per gram, and an outer air-permeable fabric layer;

b) fashioning said multi-layer fabric into an elongated hexagon shape mask member, said inner, middle and outer layers fastened peripherally together, and sized to cover at least a wearer's nose and mouth; and c) attaching to said mask member, means for securing said multi-layer mask member over at least a wearer's nose and mouth.

* * * * *